US005269743A

United States Patent [19]

Sakuma

[11] Patent Number: 5,269,743

[45] Date of Patent: Dec. 14, 1993

[54] METHOD OF IMPARTING INCREASED FOLDABILITY TO FOLD LINES IN PAPERBOARD MATERIAL FOR PAPER CONTAINERS

[75] Inventor: Kiyoshi Sakuma, Tokyo, Japan

[73] Assignees: Jujo Paper Co., Ltd., Tokyo; Shihoku Kakoki Co., Ltd., Itano, both of Japan

[21] Appl. No.: 943,107

[22] Filed: Sep. 10, 1992

Related U.S. Application Data

[63] Continuation of Ser. No. 712,164, Jun. 11, 1991, abandoned.

[30] Foreign Application Priority Data

Jun. 12, 1990 [JP] Japan ..... 2-153795

[51] Int. Cl.[5] ..... B31F 1/00; B31F 1/08; B31B 3/25

[52] U.S. Cl. ..... 493/395; 493/396; 493/459; 162/271

[58] Field of Search ..... 493/395, 396, 400, 401, 493/402, 403, 406, 459; 162/197, 271

[56] References Cited

U.S. PATENT DOCUMENTS

| | | | |
|---|---|---|---|
| 3,055,152 | 9/1962 | Williams | 493/54 |
| 4,290,764 | 9/1981 | Middel | 493/395 |
| 4,371,364 | 2/1983 | Rausing | 493/7 |
| 4,539,072 | 9/1985 | Frye et al. | 493/459 |
| 4,650,455 | 3/1987 | Kondo | 493/403 |
| 4,795,414 | 1/1989 | Blumle | 493/403 |

*Primary Examiner*—William E. Terrell

*Attorney, Agent, or Firm*—Armstrong, Westerman, Hattori, McLeland & Naughton

[57] ABSTRACT

A strip of paperboard material having a thickness of 170 to 600 μm and a multiplicity of fold lines formed widthwise thereof at a predetermined spacing and U-shaped in cross section is caused to travel as reeved around two prefolding rolls, 5 to 30 mm in diameter, from different directions at a contact angle of 40 to 270 degrees to bring the projecting side of the fold lines into contact with the peripheral suface of one of the rolls and the indented side of the fold lines with the peripheral surface of the other roll. This method imparts increased foldability to the fold lines.

8 Claims, 2 Drawing Sheets

METHOD OF IMPARTING INCREASED FOLDABILITY TO FOLD LINES IN PAPERBOARD MATERIAL FOR PAPER CONTAINERS

This application is a continuation of application Ser. No. 712,164 filed Jun. 11, 1991, abandoned.

BACKGROUND OF THE INVENTION

The present invention relates to a method of imparting increased foldability to fold lines in paperboard materials for paper containers.

Sealed paper containers are prepared from a paperboard material cut in a predetermined configuration and having a required number of fold lines U-shaped or V-shaped in cross section, by folding the material along the fold lines, adhering together specified portions of the folded material to obtain an open container, sealing off the opening after filling the container with contents, and finally forming the container in shape. The fold lines are formed usually by pressing a fold pattern of ridges against the base paper of the paperboard material using a fold forming device. The paperboard material for sealed containers comprises the base paper and a layer of polyethylene or like thermally bondable material directly formed on each surface of the base paper. When required, aluminum foil or a synthetic resin layer having barrier properties is interposed between one surface of the base paper and the layer of thermally bondable material.

In forming containers from the paperboard material having fold lines, the material is not always accurately bent or folded along the fold line. In actuality, the material is frequently folded off the fold line or with wrinkles. Variations in the folded position or wrinkles not only impair the appearance of the container as a commercial product but also deform the container, possibly causing troubles when such containers are sold by automatic vending machines.

SUMMARY OF THE INVENTION

The main object of the present invention is to provide a method of causing fold lines to fully serve their contemplated function of effecting accurate bending or folding.

The present invention provides a method of imparting increased foldability to fold lines in a paperboard material for paper containers, the paperboard material being in the form of a strip having a thickness of 170 to 600 μm, the fold lines being U-shaped or V-shaped in cross section, the method comprising causing the strip of paperboard material to travel as reeved around at least one prefolding roll, 5 to 30 mm in diameter, at a contact angle of 40 to 270 degrees.

As already stated, the paperboard material is in the form of a laminate consisting primarily of base paper. Depending on the contents to be filled into the container, the need for aluminum foil is to be considered. The kind and thickness of base paper and synthetic resin to be used, and the combination of such materials are determined suitably. While paperboard materials of varying thicknesses are available, the paperboard material itself has considerable rigidity, so that if exceeding 600 μm in thickness, the strip of paperboard material encounters difficulty in traveling as reeved around the prefolding roll. If the thickness is less than 170 μm, the material has very low rigidity, with the result that when the material is caused to travel as reeved around the prefolding roll and thereby deformed, the local stress applied to the fold line portions is too small, making it difficult to impart increased foldability to the fold lines.

When having a small diameter of 5 to 30 mm, the prefolding roll applies an increased local stress to the fold line portions of the strip of paperboard material reeved around the roll for travel, consequentlay prefolding the strip effectively at the fold lines along which the strip is to be bent or folded later. However, when less than 5 mm in diameter, the roll imposes a great stress not only on the fold line portions but also on the portions partitioned by fold lines and to be made into the side walls, top wall and bottom wall of containers, consequently entailing the likelihood that a container will be obtained as deformed unexpectedly. The fold line portions will not be stressed as required when the diameter is over 30 mm. Accordingly, the roll diameter to be determined for a particular kind of paperboard material is in the range of 5 to 30 mm, preferably 10 to 20 mm.

It is desired to make the prefolding roll rotatable in the same direction as the travel of the paperboard material with the travel so as not deface the material by the frictional contact of the roll with the material. For this purpose, the roll may be rotated by a motor or like drive means in timed relation with the speed of travel of the paperboard material, whereas when provided freely rotatably without using any drive means, the roll can be more easily rotated as timed with the travel of the material with use of simpler equipment.

If the contact angle is less than 45 degrees, the local stress to be applied to the fold line portions will be insufficient. The contact angle is preferably as large as possible insofar as the equipment space permits but is limited to 270 degrees if largest.

According to the present invention, increased foldability can be given to the fold lines before the paperboard material is bent or folded along the lines when making containers. This facilitates the subsequent bending or folding step, consequently providing paper containers which are accurately shaped perfectly in conformity with the product standard. The method of the present invention, which can be practiced by relatively simple equipment, makes it possible to produce paper containers having accurate folds in a large quantity at a high speed.

DESCRIPTION OF THE PREFERRED EMBODIMENT

Figure 1:
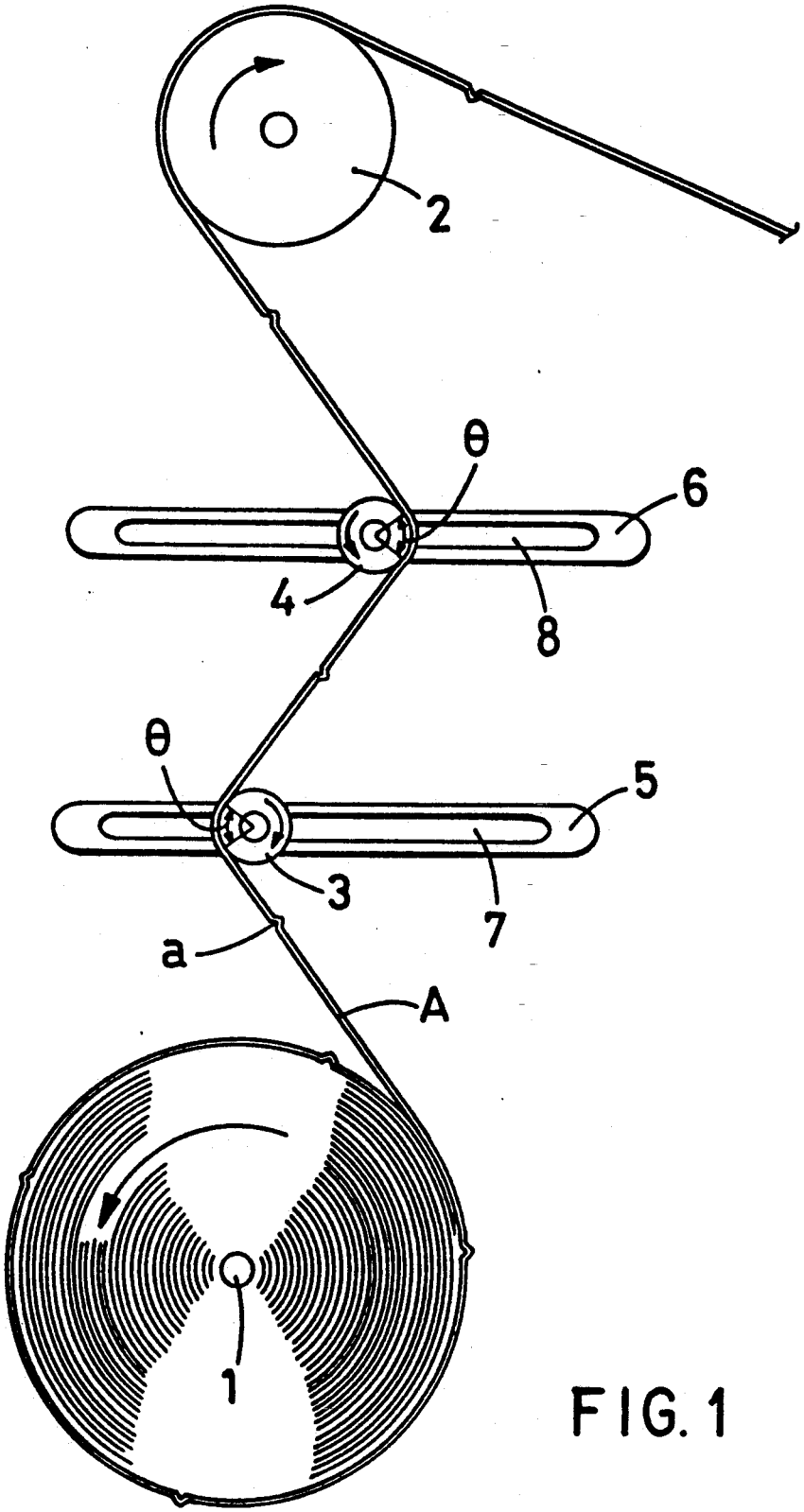
FIG. 1 is a front view schematically showing an apparatus for practicing the method of the invention.

With reference to the drawing, a strip of paperboard material A for sealed paper containers is wound up in the form of a roll on an unwinding shaft 1. Disposed above the shaft 1 is a guide roll 2 for guiding the material A in a predetermined direction. First and second prefolding rolls 3, 4 are rotatably provided between the shaft 1 and the guide roll 2. The rolls 3, 4 are provided with bearings (not shown) fixedly positioned in horizontal slits 7, 8 of horizontally elongated roll holding members 5, 6 by fastening means (not shown), the bearings being horizontally shiftable for adjustment. The first prefolding roll 3 is positioned immediate above the shaft 1, and the second prefolding roll 4 is located obliquely rightwardly above the first roll 3. The strip A is formed with a multiplicity of widthwise fold lines a spaced at a predetermined distance and U-shaped in cross section, and is wound around the shaft 1 with the indented side of the fold lines positioned inside.

Increased foldability is given to the fold lines a by unwinding the strip of paperboard material A from the shaft 1, reeving the strip A around the first prefolding roll 3 with the projected side of the lines a in contact with the peripheral surface of the roll 3 and then around the second prefolding roll 4 with the indented side of the lines a in contact with the roll surface, and causing the strip A to travel along a zigzag path.

The first and second prefolding rolls 3, 4 were used which were 10 mm in diameter. The contact angle $\theta$ of the strip of paperboard material A to be treated around the rolls 3, 4 was adjusted to 90 degrees by shifting the rolls. The strip A, which was for use in making milk containers, was composed of thick paper 270 μm in thickness, a polyethylene layer having a thickness of 20 μm and formed over one surface of the thick paper, and a polyethylene layer having a thickness of 30 μm and formed over the other surface of the paper. When the paperboard material A was made into containers, the thinner polyethylene layer provided the container outer surface, with the indented side of the fold line positioned outside. When the strip A was brought into contact with the first prefolding roll 3, the projecting side of the fold line a was compressed, and the indented side thereof was stretched. The strip A was then brought into contact with the second prefolding roll 4, whereby the projecting side of the fold line a was conversely stretched, with the indented side compressed.

The treated paperboard material A was found to be foldable apparently more easily at the positions coinciding with the fold lines a than the untreated one.

By the usual process, the treated paperboard material was bent, folded, adhered and used for filling contents, followed by sealing and forming in shape. The paper containers obtained had folds accurately along the fold lines, were free from wrinkles and were perfectly in conformity with the standard.

In this way, the paperboard material is given increased foldability so as to be accurately foldable at the fold lines. This is attributable to the following reason. The fold lines U-shaped in cross section and formed by a fold forming device give the material lower rigidity at the fold line portions than at the other portions. Further the paperboard material is stable originally when in a flat state. When the material is caused to travel as reeved around the prefolding rolls having a small diameter of 10 mm, the material is contacted as deformed to a circular-arc form with the roll sufaces, whereby a stress is applied to the deformed material. Since the fold line portions have already been made weaker than the other portions, the stress concentrates on the fold line portions locally. As a result, the fold line portions are given enhanced foldability so as to be foldable readily.

Figure 2:
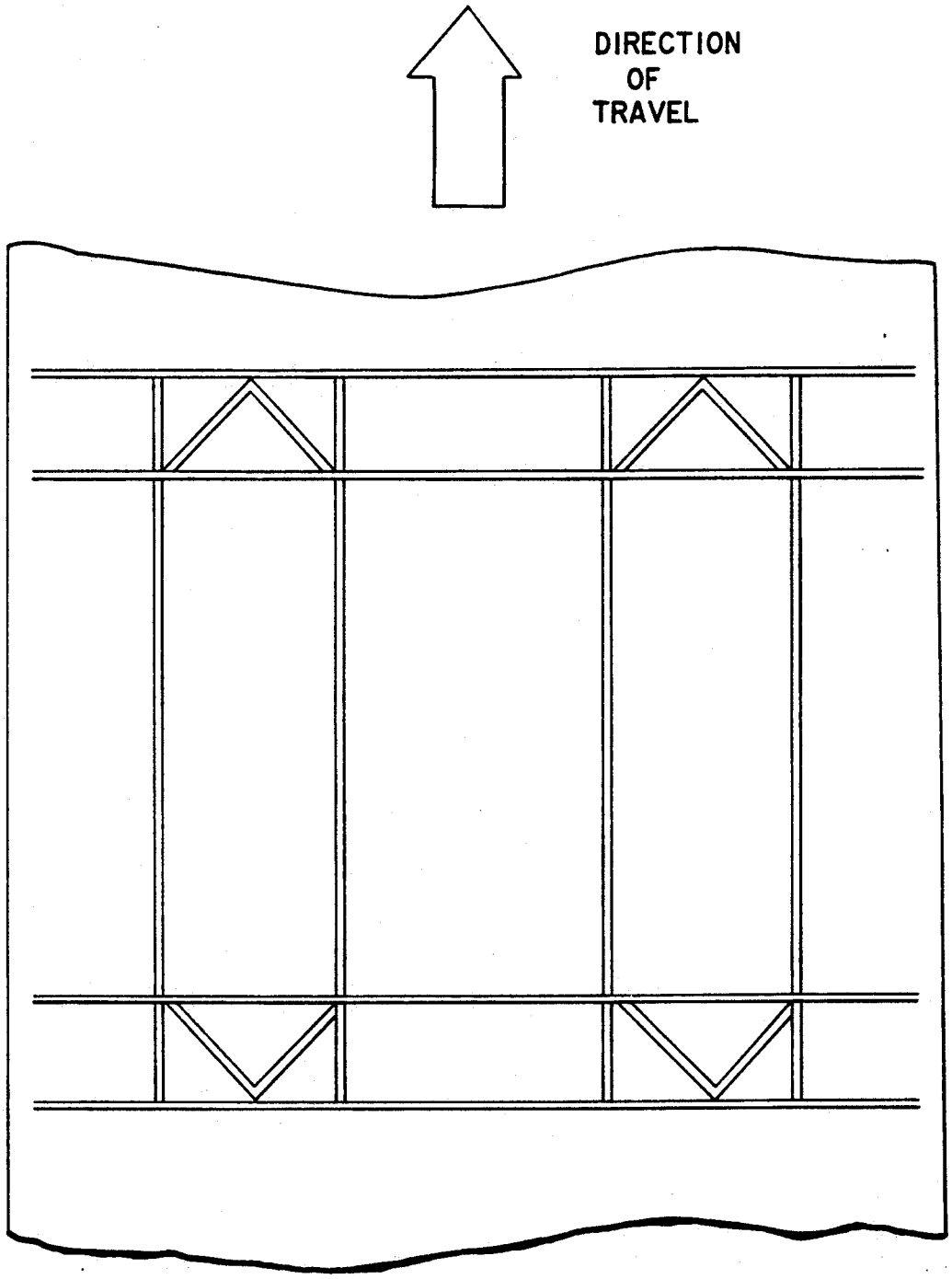
FIG. 2 shows a paperboard material having fold lines in the direction perpendicular, parallel and oblique to the direction of travel of the paperboard material.

We have found that the prefolding treatment imparts increased foldability to paperboard materials at fold lines, in any direction, e.g., perpendicular, parallel and oblique to the direction of travel of the material, as shown in FIG. 2. However, this effect is especially remarkable in the case of fold lines perpendicular to the travel direction.

Next, paperboard materials having fold lines were caused to travel as reeved around only one prefolding roll, with the indented side of the fold line in contact with the roll. In this procedure, rolls of varying diameters were used at varying contact angles. The materials treated were the above paperboard material A, and another paperboard material B for fruit juice containers which was a laminate comprising a polyethylene layer (15 μm), base paper (270 μm), polyethylene layer (30 μm), aluminum foil (7 μm) and polyethylene layer (45 μm), these layers being arranged in this order from inner side to outer side of the container to be formed.

The treated materials A, B were checked for foldability using a folding tester (universal testing instrument TENSILON RTM-100, product of Orientec Co., Ltd.) under the following testing conditions. The edge of a blade on a movable head attached to a load cell was lowered into contact with the projecting side of the fold line of the test piece as placed on two supports to fold the test pice at the fold line from one side thereof opposite to the prefolding side and measure the resistance offered. An average value was calculated from the measurements obtained for 10 test pieces of each material. The results achieved by the material A are listed in Table 1, and those by the material B in Table 2.

Test Conditions a) Load cell: 5 kg.
b) Speed of descent of movable head: 100 mm/min.
c) Distance between two supports for test piece: 30 mm.
d) Test piece: 50 mm in length, 30 mm in width, with the fold line extending over the entire width at the lengthwise midportion.
e) Position of test piece: Placed on the two supports with the fold line at the midpoint therebetween, and with the projecting side of the line up.

TABLE 1

| Roll diameter (mm) | Contact angle (deg) | | | | | |
|---|---|---|---|---|---|---|
| | Untreated | 30 | 45 | 60 | 90 | 120 |
| Untreated | 70 g | | | | | |
| 10 | | 69 g | 43 g | 36 g | 35 g | 35 g |
| 15 | | 69 g | 51 g | 45 g | 38 g | 35 g |
| 25 | | 69 g | 58 g | 50 g | 43 g | 39 g |
| 35 | | 70 g | 67 g | 63 g | 58 g | 57 g |
| 50 | | 70 g | 70 g | 68 g | 61 g | 58 g |

TABLE 2

| Roll diameter (mm) | Contact angle (deg) | | | | | |
|---|---|---|---|---|---|---|
| | Untreated | 30 | 45 | 60 | 90 | 120 |
| Untreated | 140 g | 139 g | 88 g | 81 g | 65 g | 63 g |
| 10 | | 139 g | 97 g | 88 g | 68 g | 66 g |
| 15 | | 140 g | 115 g | 94 g | 80 g | 72 g |
| 25 | | 140 g | 135 g | 130 g | 123 g | 117 g |
| 35 | | 140 g | 137 g | 134 g | 128 g | 121 g |
| 50 | | | | | | |

The method of the present invention may be incorporated as a step into a process wherein a roll of paperboard material as mounted on the unwiding shaft is formed into containers, which are then filled with contents and sealed off by sequential steps for preparing sealed paper containers with the contents as a commercial product. Alternatively, the method may be practiced when the paperboard material formed with fold lines is wound up into a roll.

Although the drawing shows two prefolding rolls, at least three rolls are usable. The fold line is not limited to a U-shaped cross section but may be V-shaped.

When a single prefolding roll is used, the paperboard material is reeved around with roll with the projecting side of the fold line in contact with the roll surface as already described. Conversely, however, the projecting side of the line may be brought into contact with the roll surface.

The method of the present invention can of course be used also in the case where the paperboard material is made of paper only.

What is claimed is:

1. A method of imparting increased foldability to fold lines in a paperboard material for paper containers, the paperboard material being in the form of a strip having a thickness of 170 to 600 μm and having therein the fold lines, the fold lines being U-shaped or V-shaped in cross section, the method comprising the steps of:

unwinding the strip of paperboard material; and causing the strip of paperboard material to travel as reeved around at least two prefolding rolls, each of between 10 and 20 mm in diameter, and at a contact angle of between 40 and 270 degrees, wherein the at least two prefolding rolls contact each side of said strip through substantially equal said contact angles.

2. A method as defined in claim 1 wherein the strip of paperboard material is caused to travel as reeved around the prefolding rolls with the indented side of the fold line brought into contact with the peripheral surface of at least one of the rolls.

3. A method as defined in claim 1 wherein the strip of paperboard material is caused to travel as reeved around the prefolding rolls with the projecting side of the fold line brought into contact with the peripheral surface of at least one of the rolls.

4. A method as defined in claim 1 wherein the strip of paperboard material is caused to travel as reeved around at least two prefolding rolls so as to bring the indented side and the projecting side of the fold line into contact with the respective rolls over the peripheral surface thereof.

5. A method as defined in claim 1 wherein the prefolding rolls are freely rotatable.

6. A method as defined in claim 1 wherein the fold lines extend perpendicular, parallel and obliquely to the direction of travel of the strip.

7. A method as defined in claim 1 wherein a location of at least one prefolding roll is adjustable.

8. A method as defined in claim 4 wherein locations of the prefolding rolls are adjustable relative to each other.

* * * * *